United States Patent [19]

Al-Jaroudi

[11] Patent Number: 4,885,043

[45] Date of Patent: Dec. 5, 1989

[54] METHOD FOR SELECTIVE DECARBURIZATION OF IRON BASED MATERIAL

[75] Inventor: Mohammed Y. Al-Jaroudi, Stockholm, Sweden

[73] Assignee: International Business Machines Corporation, Armonk, N.Y.

[21] Appl. No.: 162,719

[22] Filed: Mar. 1, 1988

[30] Foreign Application Priority Data

Mar. 23, 1987 [SE] Sweden ..... 8701197

[51] Int. Cl.[4] ..... C21D 3/04

[52] U.S. Cl. ..... 148/113; 148/14

[58] Field of Search ..... 148/14, 113

[56] References Cited

U.S. PATENT DOCUMENTS

| | | | |
|---|---|---|---|
| 4,226,082 | 10/1980 | Nishida | 428/627 |
| 4,411,960 | 10/1983 | Mizuhara | 428/610 |
| 4,414,043 | 11/1983 | Davis et al. | 148/14 |
| 4,439,252 | 3/1984 | Iwamoto et al. | 148/113 |
| 4,713,123 | 12/1987 | Inokuti | 148/113 |

FOREIGN PATENT DOCUMENTS

| | | | |
|---|---|---|---|
| 1153045 | 8/1963 | Fed. Rep. of Germany | 148/113 |
| 0022375 | 2/1983 | Japan . | |
| 0212164 | 12/1984 | Japan . | |
| 0085248 | 5/1985 | Japan . | |
| 0201732 | 9/1986 | Japan | 148/113 |
| 0675769 | 7/1952 | United Kingdom | 148/14 |

OTHER PUBLICATIONS

Palmai et al., "Iron Tool With at Least Two Surface . . . ", Chem. ab. 99:126700r, 1983, vol. 99, p. 252.

Mathesius et al., "Chemical Vapor Deposition at Intermediate . . . ", Metals Ab., 57-0855, vol. 85(11), p. 217, 1985.

Al-Jaroud: et al., "The Influence of Titanium Mononitride. . . ", Chem. Abs. 108:98637j;, vol. 108, p. 263, 1988 (1987).

*Primary Examiner*—L. Dewayne Rutledge
*Assistant Examiner*—David W. Schumaker
*Attorney, Agent, or Firm*—Robert W. Lahtinen

[57] ABSTRACT

A method for the selective decarburization of an iron based substrate, such as a silicon iron substrate, wherein the carbon present in the substrate is extracted by the selective deposition of a titanium nitride layer or film on the substrate.

10 Claims, 2 Drawing Sheets

METHOD FOR SELECTIVE DECARBURIZATION OF IRON BASED MATERIAL

TECHNICAL FIELD

The invention described and claimed herein relates to a method for selectively decarburizing iron based material and more particularly, decarburizing a silicon iron substrate.

BACKGROUND OF THE INVENTION

The prior art includes methods for selective carborization and heat treatment of iron based material during the hardening processes. Such a method is, for example, described in the Swedish Patent No. 8400781 to D. B. Larsen, issued Feb. 27, 1986. In accordance with the method of this patent selective carburization is obtained by selectively covering the substrate with an electro deposited copper alloy layer. If the copper layer is sufficiently deep, no carburization will occur beneath the layer.

However, the carbon content present prior to the application of the copper layer will still be there. Any residual carbon content reduces the magnetic permeability.

SUMMARY OF THE INVENTION

The method of the present invention overcomes this problem. It solves the problem by the use of a physical vapor deposition process to selectively deposit a thin film of titanium nitride on the surface of the iron based material, whereby the carbon present in the material is extracted. The mechanism of this extraction is not fully known. However, there are some indications that the carbon has reacted with the titanium nitride.

BRIEF DESCRIPTION OF THE DRAWING

The invention, which is defined in the appended claims, is described in detail below with reference to the drawing figures wherein

DETAILED DESCRIPTION OF THE INVENTION

Figure 1:
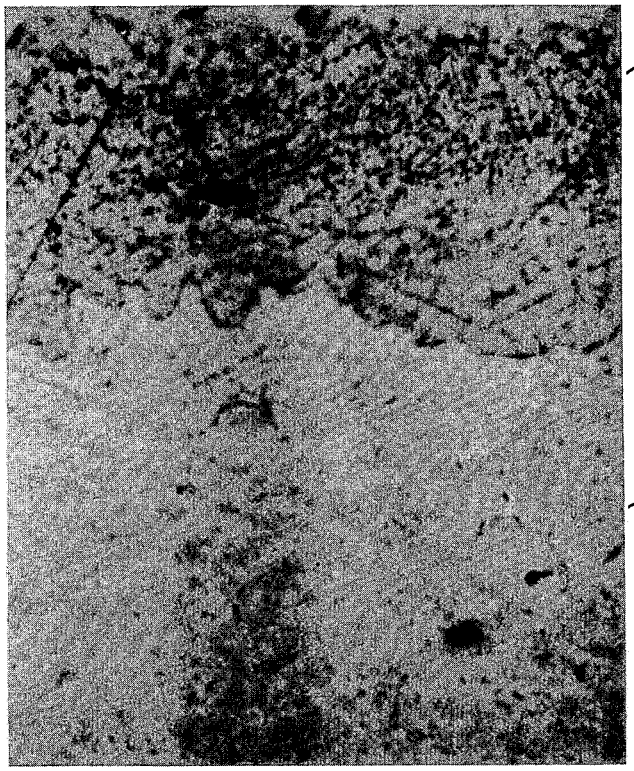
FIG. 1 shows a cross-section of a carburized silicon iron substrate and FIG. 2 shows a cross-section of the same substrate after the titanium film has been deposited on the substrate.
Figure 2:
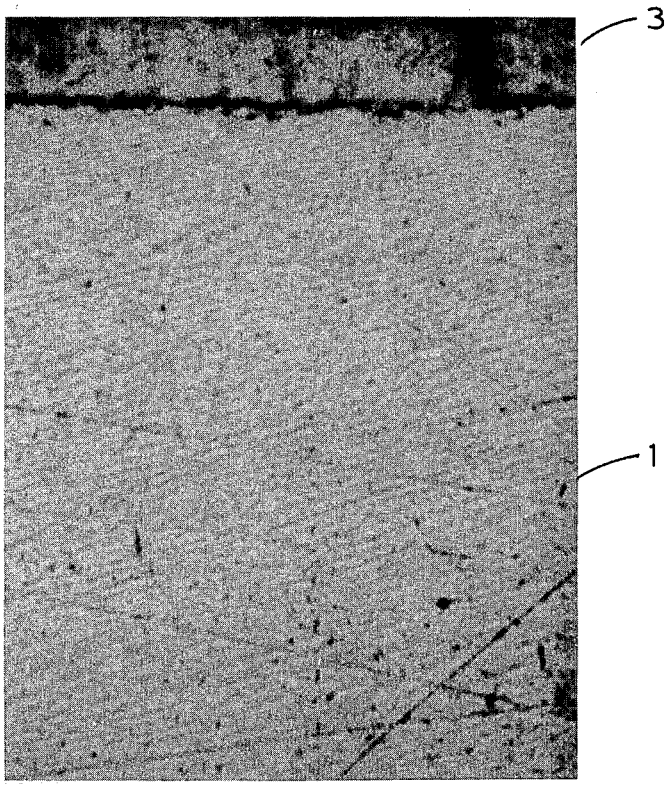

The method according to the invention is described below with reference to the drawings. Although the method is applicable in several processes where selective decarburization of iron based materials is desired, the description below is directed to a process for decarburization of a silicon iron substrate. Silicon iron is extensively used within the electrical and electronic fields, for example, in various kinds of transducers, cores and transformers. The carbon content in some applications negatively affects the magnetic characteristics of the silicon iron. The process according to this invention remedies this drawback. In practicing the process, the carbon of the silicon iron substrate is extracted by depositing a titanium film or layer on its surface. FIG. 1 shows a cross-section of a carburized silicon iron substrate scanned by an electron microscope. The carburization is performed in order to better show the decarburization effect. FIG. 1 shows the penetration of carbon into a silicon iron substrate 1 using a carburization process. Thereafter, substrate 1 has been heat treated so that a layer 2 of martensitic structure has been created. FIG. 2 shows a cross-section of the same substrate after a titanium nitride layer 3 has been deposited on it. The titanium nitride layer or film may be deposited on the substrate surface by vacuum deposition processes such as physical vapor deposition or plasma sputtering. Metallurgical inspection of the cross-section shows that the martensitic structure has completely dissolved and the substrate structure is completely ferritic, that means, the carbon has been extracted from the layer 2.

Martensitic silicon iron is non-ferritic and has low permeability, whereas, the completely carbon free silicon iron has a very high permeability.

In one embodiment of the invention, a thin substrate of silicon iron is carburized and heat treated in a conventional way in order to give the substrate a martensitic structure. After that the surface of the sheet is masked by a copper layer electro plated in a conventional manner onto the surface so that a predetermined, desired pattern of the silicon iron sheet is left uncovered. The substrate is then put into a vacuum chamber containing a nitrogen-argon gas at a pressure of about 5 mtorr and the masked surface is exposed to plasma sputtering from a titanium source at about 420 volts and with a current of about 4 amperes for about 60 minutes. The process is performed at a temperature of 20 to 600 degrees C., preferably at a temperature of 20 to 100 degrees C. The copper layer is then removed by a conventional etching process.

Using the described method, a thin silicon substrate has been obtained which has a desired pattern of high permeability regions.

While the invention has been particularly described in connection with a specific iron based material, silicon iron, it will be understood by those skilled in the art that various changes may be made without departing from the spirit and scope of the invention.

What is claimed is:

1. The method for selective decarburization of an iron based substrate by extraction of carbon present in the iron based substrate comprising the steps of masking the surface of said iron based substrate with a plated metal layer leaving a predetermined pattern of the substrate surface uncovered;

depositing a titanium nitride film onto the surface of the substrate by vacuum deposition at a temperature not exceeding 600 degrees centigrade to remove from the unmasked substrate surface portions; and thereafter removing the selectively applied metal masking layer.

2. The method for selective decarburization of claim 1, wherein said titanium nitride film is deposited by a physical vapor deposition process.

3. The method for selective decarburization of claim 1, wherein the titanium nitride film is deposited by plasma sputtering.

4. The method for selective decarburization of claim 2, wherein the physical vapor deposition is performed in a vacuum chamber containing a titanium source and into which an argon-nitrogen gas is introduced.

5. The method for selective decarburization of claim 4, wherein said iron based substrate is a silicon iron substrate.

6. The method for selective decarburization of claim 4, wherein the physical vapor deposition is performed at a potential of 420 volts and a current of 4 amperes for a duration of 60 minutes.

7. The method for selective decarburization of claim 4, wherein the argon-nitrogen gas is introduced at a pressure of 5 mtorr.

8. The method for selective decarburization of claim 4, wherein the titanium nitride film is deposited at a temperature of 20 to 600 degrees C.

9. The method for selective decarburization of claim 2, wherein the titanium nitride film is deposited at a temperature of 20 to 100 degrees C.

10. The method for selective decarburization of claim 3, wherein the titanium nitride film is deposited at a temperature of 20 to 100 degrees C.

* * * * *